US012138520B2

(12) United States Patent
Jodha

(10) Patent No.: US 12,138,520 B2
(45) Date of Patent: Nov. 12, 2024

(54) GOLF BALL RETURN DEVICE

(71) Applicant: Gunpal Singh Jodha, Kitchener (CA)

(72) Inventor: Gunpal Singh Jodha, Kitchener (CA)

( * ) Notice: Subject to any disclaimer, the term of this patent is extended or adjusted under 35 U.S.C. 154(b) by 264 days.

(21) Appl. No.: 17/647,295

(22) Filed: Jan. 6, 2022

(65) Prior Publication Data

US 2022/0241664 A1 Aug. 4, 2022

Related U.S. Application Data

(60) Provisional application No. 63/199,549, filed on Jan. 7, 2021.

(51) Int. Cl.
*A63B 69/36* (2006.01)

(52) U.S. Cl.
CPC ..... *A63B 69/3661* (2013.01); *A63B 2209/08* (2013.01)

(58) Field of Classification Search
CPC ..... A63B 69/3661; A63B 69/3676; A63B 2209/08
See application file for complete search history.

(56) References Cited

U.S. PATENT DOCUMENTS 2,709,594 A * 5/1955 Brandell ..... A63B 57/405 273/129 R
3,003,769 A * 10/1961 Brandell ..... A63B 57/405 273/125 A
3,030,113 A 4/1962 Brandell
3,134,597 A * 5/1964 Brandell ..... A63B 69/3676 273/129 R
3,134,934 A * 5/1964 Brandell ..... A63B 69/3676 335/278
3,306,619 A * 2/1967 Brandell ..... A63B 57/40 473/189
3,697,079 A * 10/1972 Brandell ..... A63B 57/405 473/183
3,796,434 A * 3/1974 Moss ..... A63B 57/405 273/129 R
3,799,555 A * 3/1974 Brandell ..... A63B 57/405 473/183
3,810,632 A * 5/1974 Brandell ..... A63B 57/405 473/183
4,078,806 A * 3/1978 Brandell ..... A63B 57/405 473/183
4,249,739 A * 2/1981 Brandell ..... A63B 57/405 473/183
6,213,887 B1 * 4/2001 Carney ..... A63B 63/00 473/220
6,623,371 B2 9/2003 Corcoran

FOREIGN PATENT DOCUMENTS

KR 20150097993 A * 8/2015
WO WO-2004082775 A1 * 9/2004 ..... A63B 47/025

* cited by examiner

*Primary Examiner* — Joshua T Kennedy

(57) ABSTRACT

A golf ball return device for putting mats that does not require a golf ball to go up a ramp for it to be returned to the golfer. This is achieved by utilizing the thickness of the putting mat to gravitate the golf ball to a ball kick area from where a kick-back device bounces the golf ball back to the golfer.

19 Claims, 11 Drawing Sheets

FIG 6A
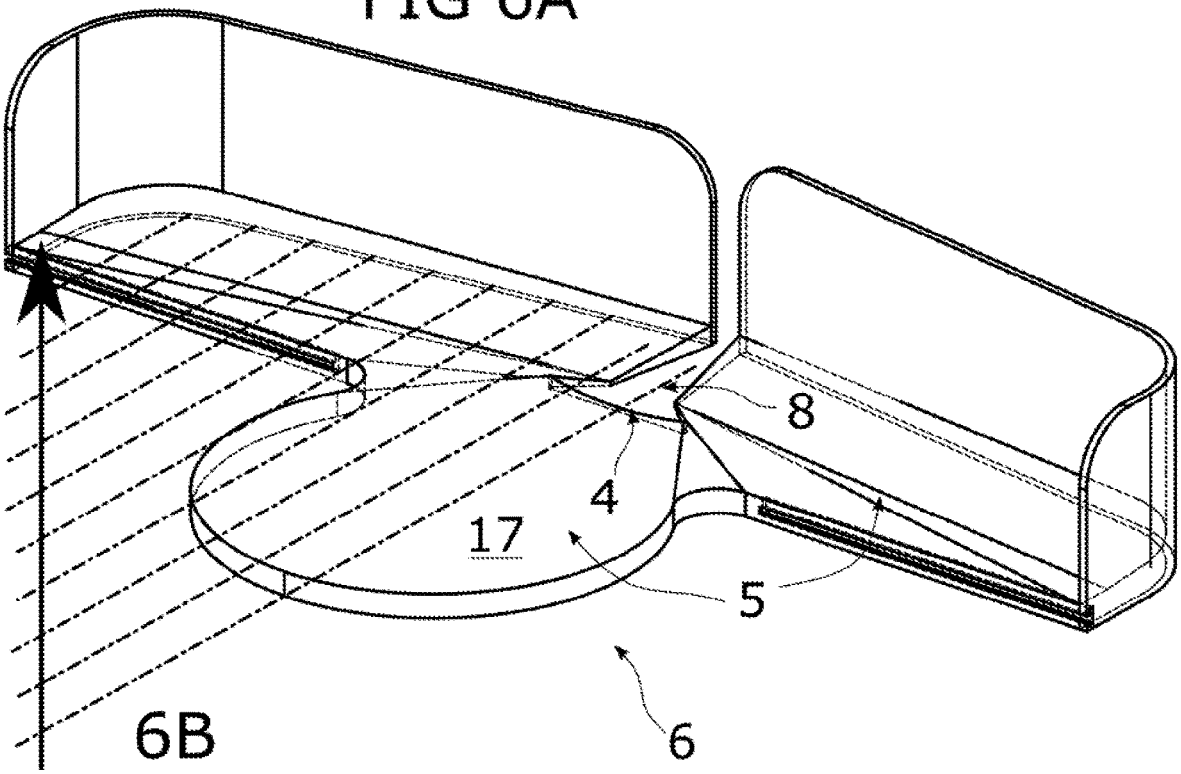
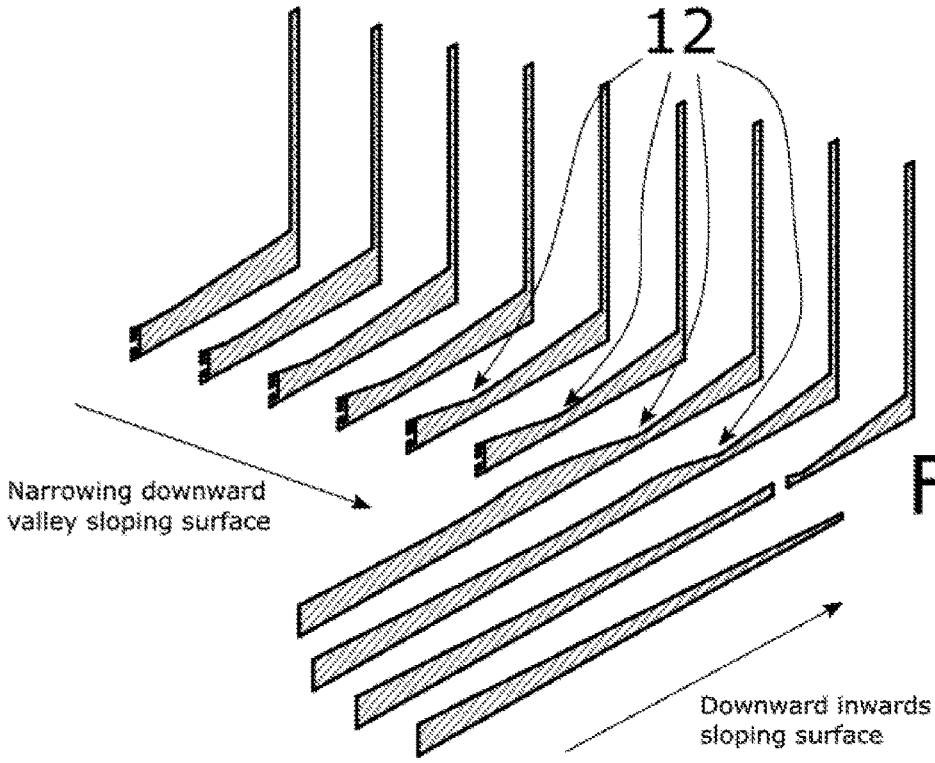
FIG 6B

FIG 7A
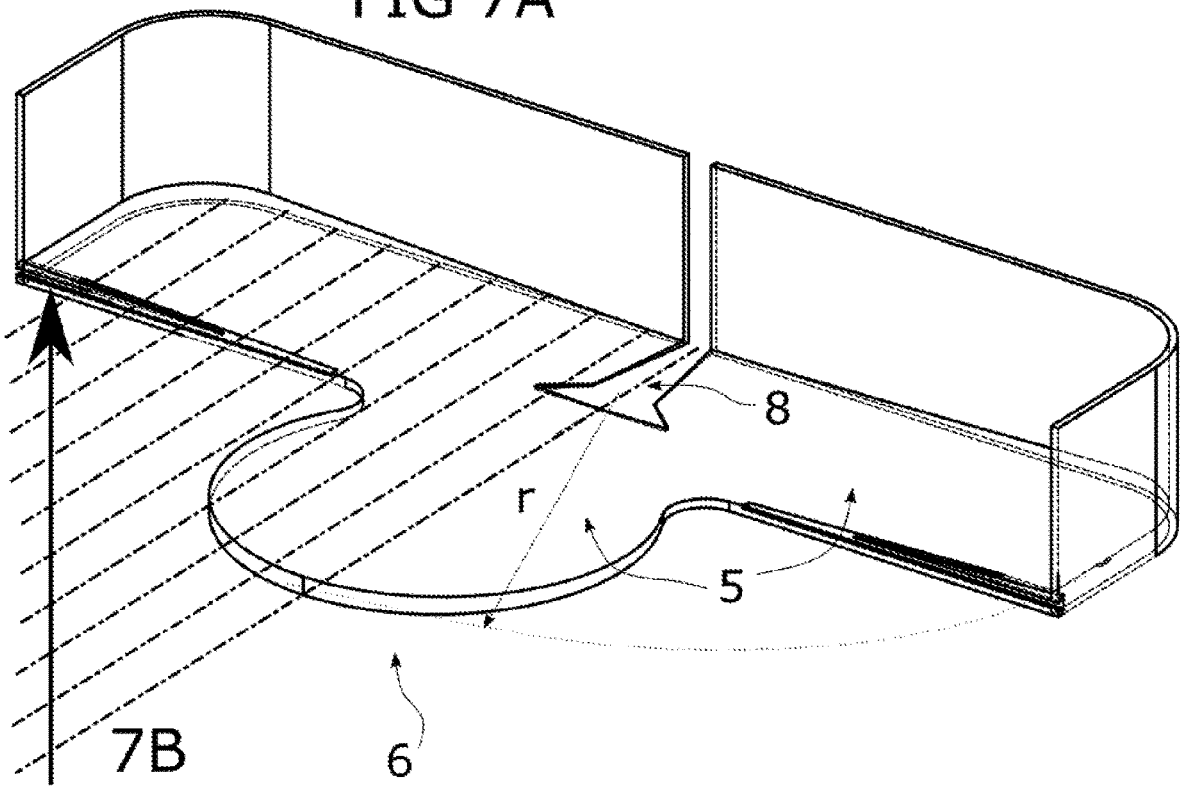
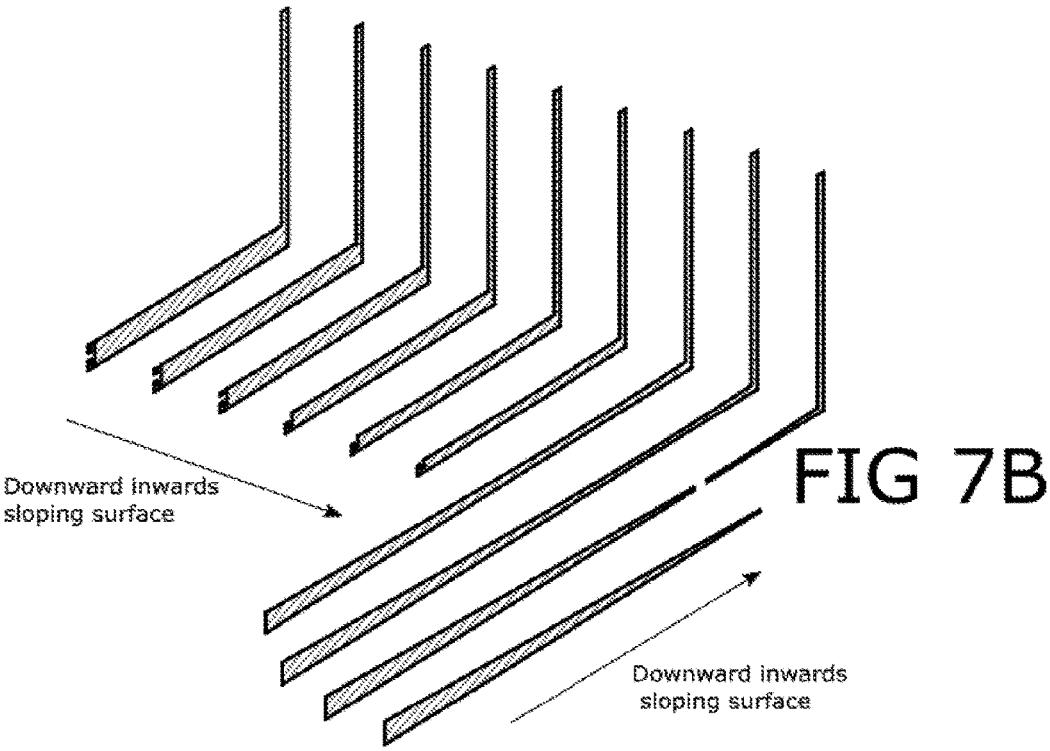
FIG 7B

GOLF BALL RETURN DEVICE

CROSS-REFERENCE TO RELATED PATENT APPLICATIONS

The invention claims priority from U.S. Provisional Patent Application No. 63/199,549 entitled "Golf ball return device for putting mats" by: Gunpal Singh Jodha, and filed on Jan. 7, 2021, which Provisional Patent Application is hereby incorporated by reference in its entirety.

TECHNICAL FIELD

The present disclosure relates to golf apparatuses, and more particularly to a golf ball return device that can be used with putting mats.

BACKGROUND

Golfers typically practice putting on either an actual golf green or a putting mat (e.g. a mat/rug whose upper surface closely represents a typical golf green surface). In both cases it is beneficial from an efficiency standpoint to have the ball returned to the golfer so the golfer does not have to walk to retrieve the ball. For putting mats with a powered kick-back mechanism, the ball is made to go up a slope to gain sufficient height from the floor before reaching the target. This height/slope is then utilized to facilitate movement of the ball towards a ball kick area (or equivalent) using gravitational force, where a powered kick-back mechanism kicks the ball back to the golfer.

SUMMARY OF PARTICULAR EMBODIMENTS

It will be appreciated by those skilled in the art that other variations of the embodiments described below may also be practiced without departing from the scope of the invention. Further note, these embodiments, and other embodiments of the present invention will become more fully apparent from a review of the description and claims which follow.

In one embodiment, the present disclosure relates to a golf ball return device for putting mats. In this embodiment, the golf ball return device can be used with putting mats and does not require the ball to go up a slope before reaching the target in order for the device to return the ball to the golfer.

In one particular embodiment, the golf ball return device lies adjacent to the distal end of the putting mat with the target lying at the same or lower level than the upper surface of the putting mat. In this embodiment, a golf ball struck by a golf club that has rolled on the putting mat and reached the distal end of the putting mat is positioned at a certain height above the floor due to the thickness of the putting mat. The golf ball return device of the present disclosure leverages the height of the ball above the floor due to the thickness of the putting mat to gravitate the ball towards a ball kick area where a powered kick-back mechanism kicks the ball back to the golfer.

BRIEF DESCRIPTION OF THE SEVERAL VIEWS OF THE DRAWINGS

In the drawings, preferred embodiments of the invention are illustrated by way of example. It is to be expressly understood that the drawings are only for the purpose of illustration and as an aid to understanding and are not intended as a definition of the limits of the invention. The embodiments herein will be understood from the following description with reference to the drawings, in which:

FIG. 6A illustrates a perspective view of the collector in accordance with a first embodiment of the present disclosure.

FIG. 6B illustrates perspective sectional views of multiple sections taken along lines 6B in FIG. 6A FIG. 7A illustrates a perspective view of the collector according to a second embodiment of the present disclosure.

FIG. 7B illustrates perspective sectional views of multiple sections taken along lines 7B in FIG. 7A

DETAILED DESCRIPTION OF THE INVENTION

Figure 1:
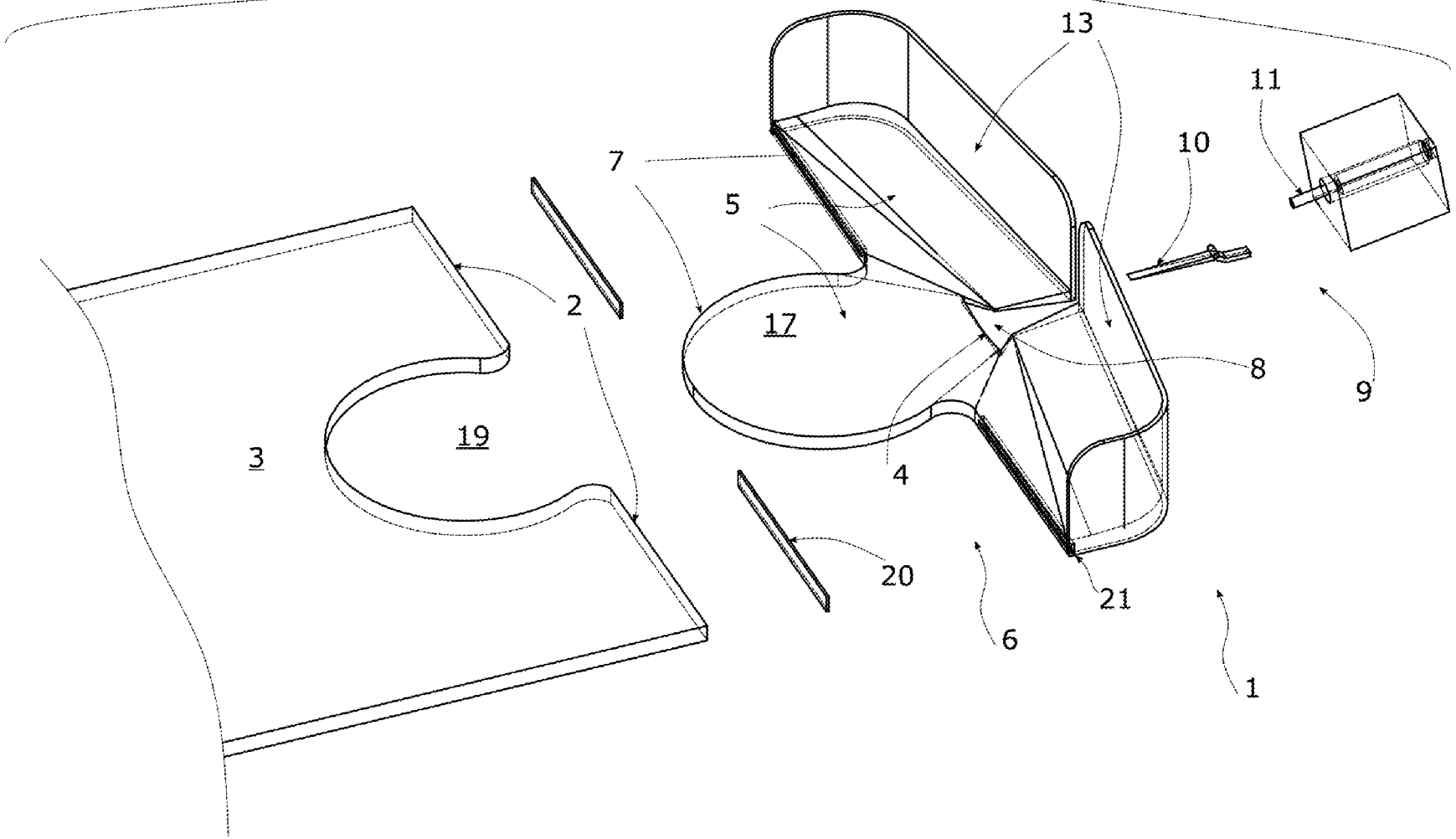
FIG. 1 illustrates an exploded perspective view of a golf ball return device in accordance with one embodiment of the present disclosure.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. In particular, all terms used herein are used in accordance with their ordinary meanings unless the context or definition clearly indicates otherwise. Also, unless indicated otherwise except within the claims the use of "or" includes "and" and vice-versa. Non-limiting terms are not to be construed as limiting unless expressly stated or the context clearly indicates otherwise (for example, "including", "having", "characterized by" and "comprising" typically indicate "including without limitation"). Singular forms included in the claims such as "a", "an" and "the" include the plural reference unless expressly stated or the context clearly indicates otherwise. Further, the stated features and/or configurations or embodiments thereof the suggested intent may be applied as seen fit to certain operating conditions or environments by one experienced in the field of art.

Referring to the drawings, FIG. 1 illustrates an exploded perspective view of a first embodiment of the present disclosure, a golf ball return device 1. This embodiment includes a collector 6, an at least one blocking wall 13, and a kick-back device 9 or equivalent. In the embodiment shown and described, the collector 6 has an at least one collector receiving edge 7 where the collector abuts the putting mat 3, a ball kick area 8 towards its distal end, and a ball roll surface 5 which, in one embodiment constitutes substantially the entire upper surface of the collector 6. A putting mat 3 lies before the collector receiving edge 7. The putting mat 3 has a circular segment having diameter equal to that of a typical golf hole (of course, other shaped segments are permitted) and chord running in line with the putting mat distal edge 2, cut out from the putting mat's distal end to form a cutout 19 that allows to snugly fit the collector head 17 into the cutout 19. The putting mat 3 has an at least one magnetic member 20, such as an at least one thin magnetic material sheet, at its distal edge. The collector 6 has an at least one slot for placement of an at least one magnet 21 within each at least one slot, preferably on each arm. The collector receiving edge 7 is where the ball transitions from rolling on the putting mat 3 to rolling on the ball roll surface 5. The ball kick area 8 is the area where the ball needs to arrive to be kicked back to the golfer. Blocking walls 13 face upward from the surface of the collector 6 and extend from the ends of the collector receiving edge 7 along the sides of the collector 6 to the distal end of the collector behind the ball kick area 8. Adjacent to the ball kick area 8 is a kick-back device 9 or equivalent. A typical kick-back device includes a form of trigger 10 and plunger 11 mechanism, such as the one shown and described herein.

Figure 2:
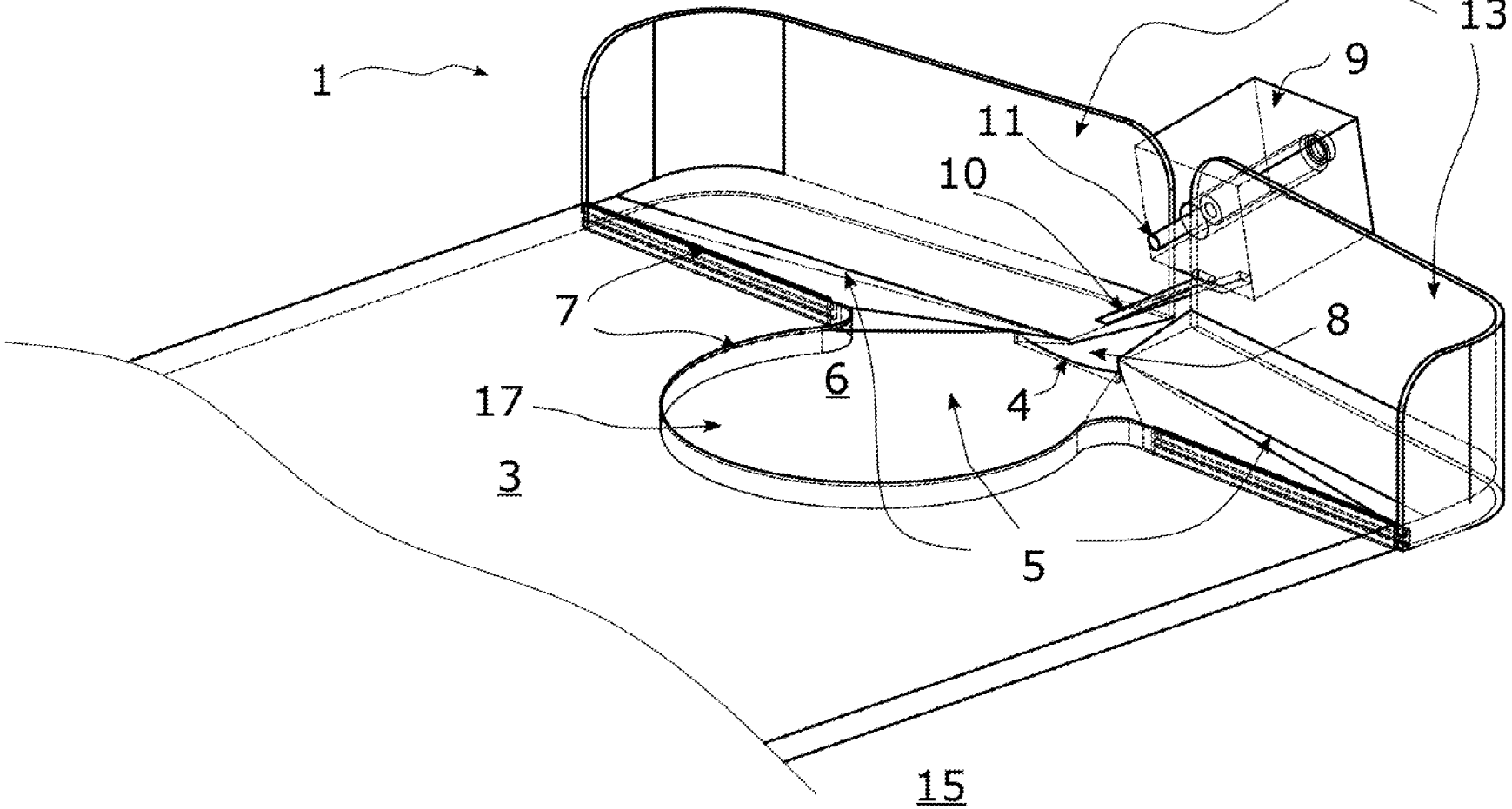
FIG. 2 illustrates an assembled perspective view of a first embodiment of a golf ball return device in accordance with one embodiment of the present disclosure.

FIG. 2 illustrates an assembled perspective view of a first embodiment of the device of the present disclosure, a golf ball return device 1. In this embodiment, a putting mat 3 lies on a floor 15 (or other horizontal surface) before the collector receiving edge 7 and the collector head 17 from FIG. 1 can be seen fit into the cutout 19 shown in FIG. 1. The collector head 17 surface serves as the target and is representative of a golf hole. In operation, a ball struck by the user's golf club in the direction of the collector 6 would roll in a longitudinal direction from putting mat 3 towards collector 6. As a ball rolls onto the ball roll surface 5 from the putting mat 3, the ball is directed by gravitational forces and the ball roll surface 5 towards the ball kick area 8. The at least one blocking wall 13 prevents the ball from crossing the ball roll surface 5 and away from the device 1. The ball kick area 8 may take the form of a through pocket in the collector 6 that has a bounce edge 4. In the embodiment shown, the kick-back device 9 is mounted close to the ball kick area 8 to allow the ball to keep triggering the trigger 10 until the plunger 11 kicks the ball away from the ball kick area 8 in the direction of the golfer. The kick-back device 9 may be secured in multiple ways, for example, by being attached to the collector 6 or may be kept in a casing that is joined to the collector 6.

Figure 3:
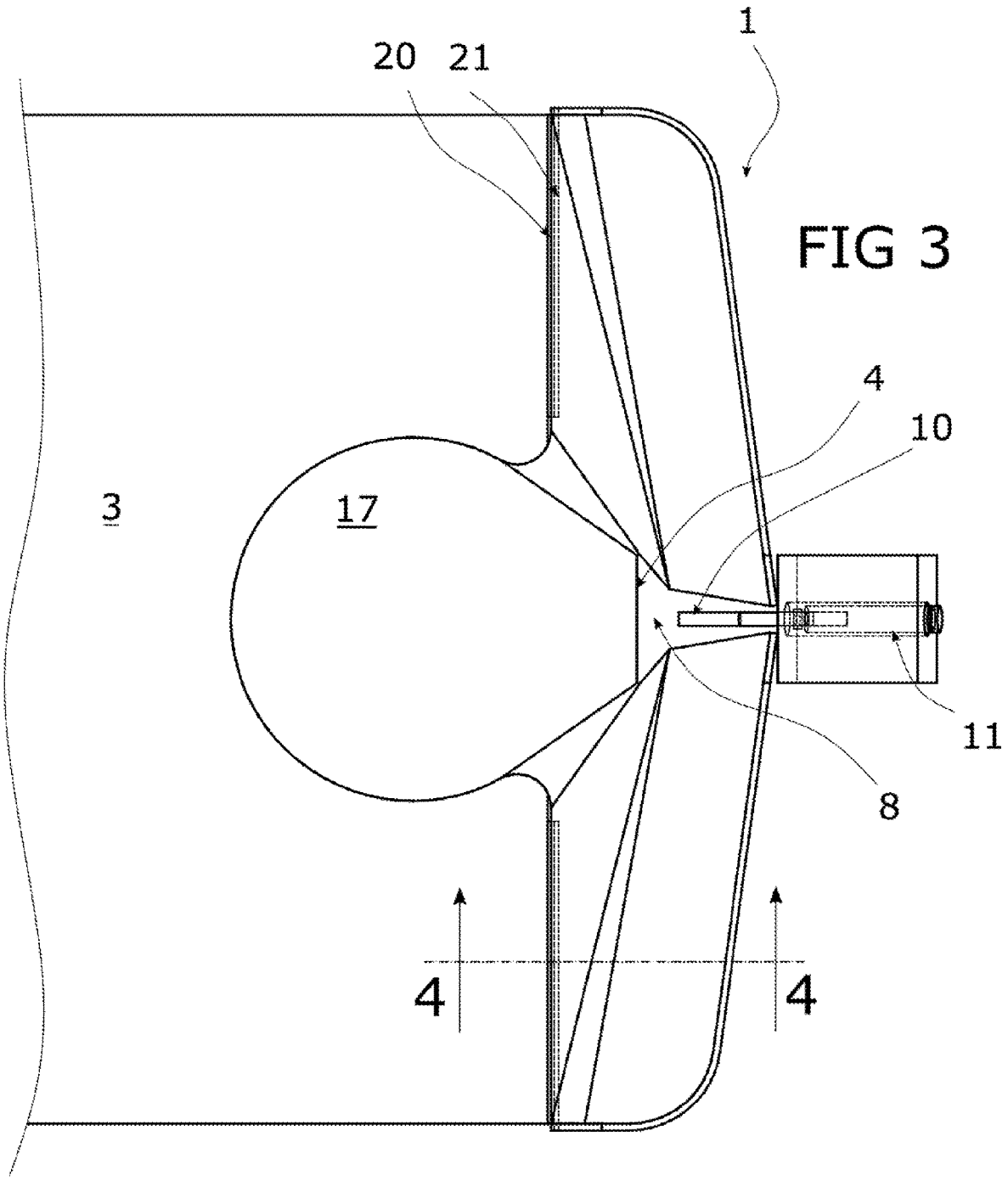
FIG. 3 illustrates a top view of a golf ball return device in accordance with one embodiment of the present disclosure.

FIG. 3 illustrates a top view of a first embodiment of the device of the present disclosure, a golf ball return device 1. In this embodiment, the outer perimeter of the collector head 17 is substantially surrounded, or completely surrounded by the putting mat 3 and is releasably held in abutment with the putting mat 3 via the magnetic force between the at least one magnetic member 20 on the putting mat 3 and the at least one magnet 21 in the at least one slot for magnets in the collector 6, where the at least one magnetic member and the at least one magnet in the at least one slot are magnetically attracted to each other. In operation, a ball that enters the ball kick area 8 would come to rest before the bounce edge 4 at which point it would engage the trigger 10. The ball may continuously engage the trigger 10 for one or more seconds only after which the plunger 11 is activated to kick the ball. This would allow the ball time to lose its momentum and become relatively stationary before being kicked back. This may be accomplished by a time delay relay or a spring recoil mechanism that takes time to recoil.

Figure 4:
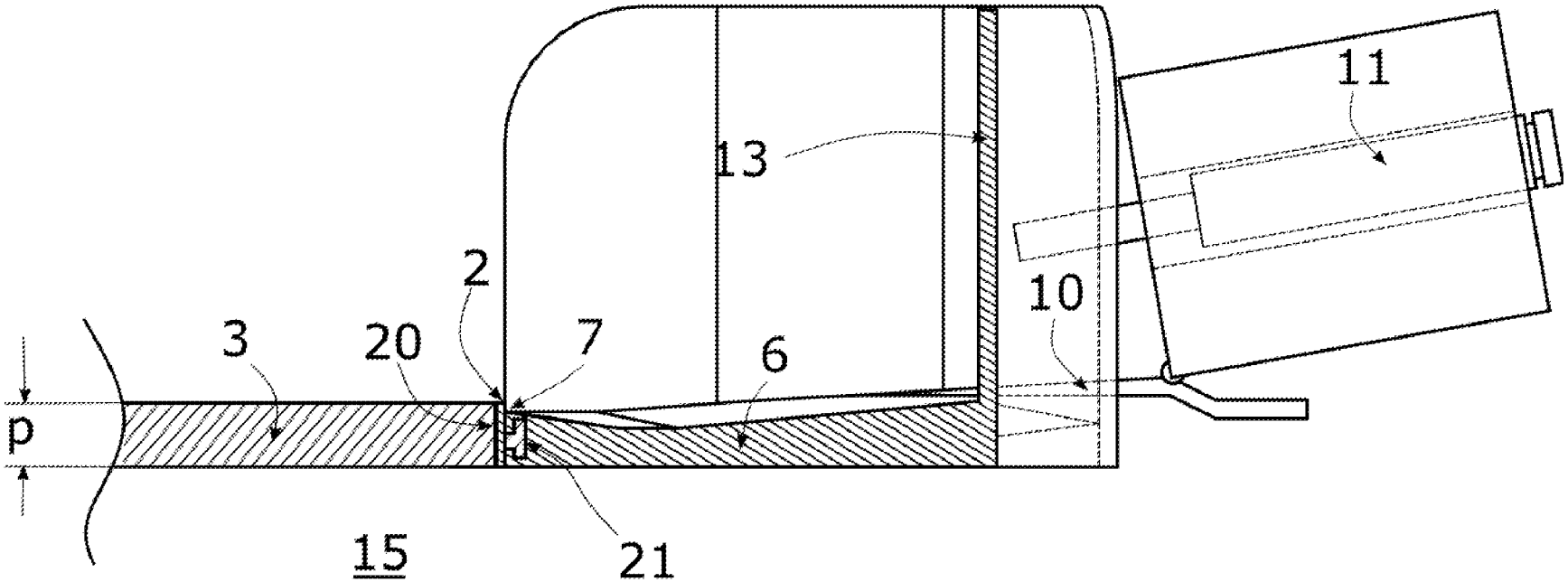
FIG. 4 illustrates a magnified section view of the device of FIG. 3 as taken along lines 4-4.

FIG. 4 illustrates a magnified sectional view of FIG. 3 that shows that the height of the collector receiving edge 7 from the floor 15 is less than or equal to the putting mat thickness p and is therefore at or below the putting mat distal edge 2. The at least one magnetic member 20 on the edge of the putting mat 3 can also be seen abutting the collector 6 due to the use of magnets 21, as shown and described herein. Other suitable means may be employed to releasably secure the putting mat to the outer perimeter of the collector 6.

Figure 5A:
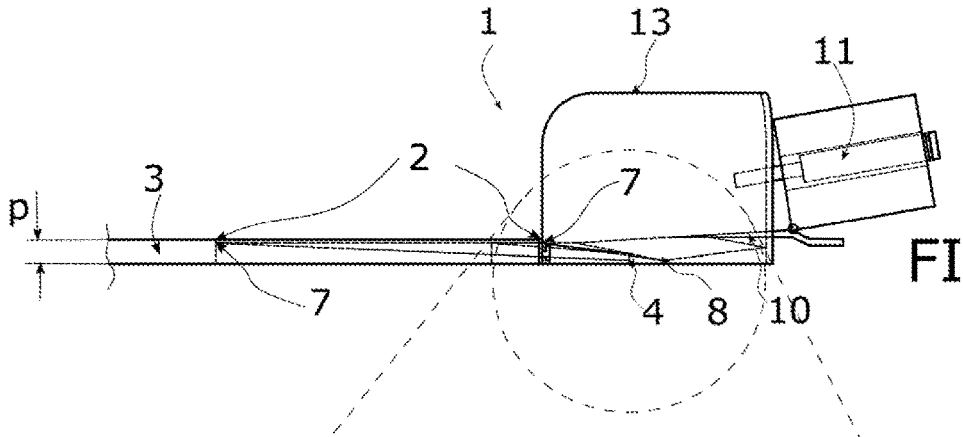
FIG. 5A illustrates a right elevation view of a golf ball return device in accordance with one embodiment of the present disclosure.
Figure 12:
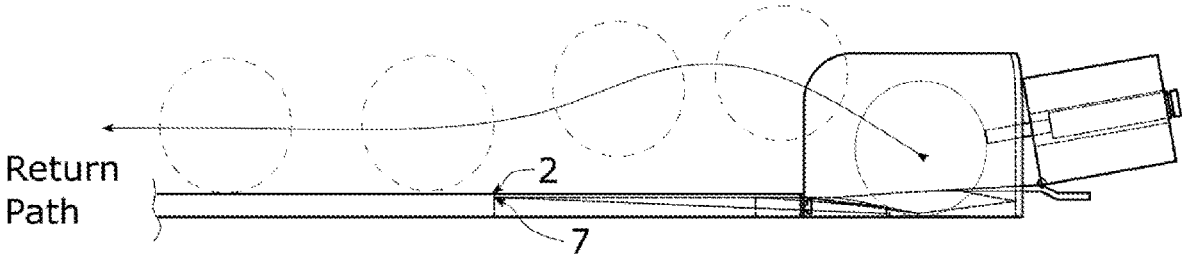
FIG. 12 illustrates a right elevation view of a golf ball return device in accordance with one embodiment of the present disclosure showing the return path taken by a golf ball.

FIG. 5A illustrates a right elevation view of a first embodiment of the device of the present disclosure, a golf ball return device 1. It shows the plunger 11 may be positioned such that it kicks the ball at a downward angle to cause the ball to bounce against the bounce edge 4 as it is propelled back towards the golfer. This could allow the ball to jump over the collector receiving edge 7 and the putting mat distal edge 2 as it moves towards the golfer as seen in FIG. 12. This could be helpful if the collector receiving edge 7 is disposed below the putting mat distal edge 2 as the putting mat distal edge 2 may become an obstruction to the ball travelling towards the golfer.

Figure 5B:
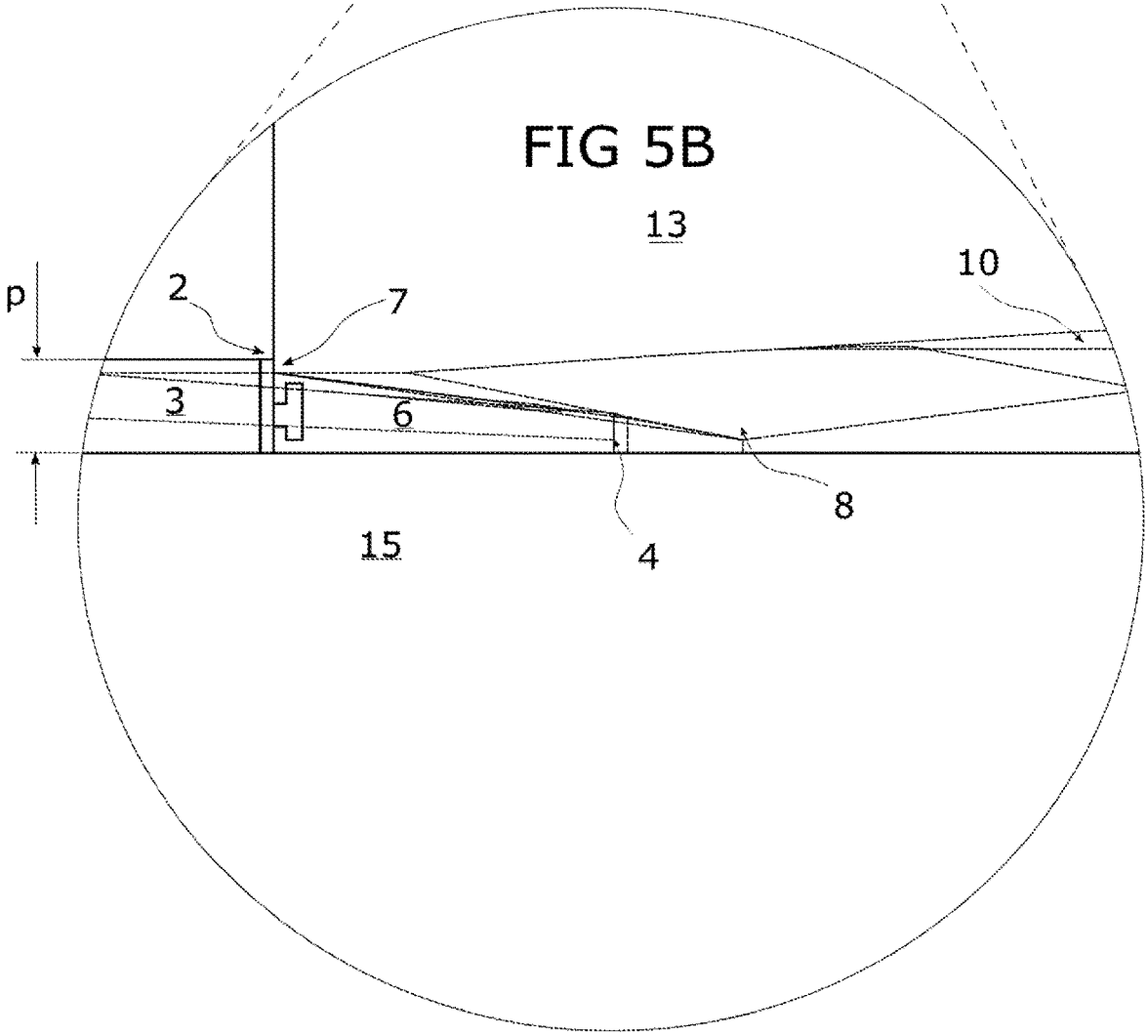
FIG. 5B illustrates a magnified view of a portion of FIG. 5A

FIG. 5B illustrates a magnified view of a portion of the device shown in FIG. 5A. Here, as well, it can be seen that the height of the collector receiving edge 7 from the floor 15 is less than or equal to the putting mat thickness p, and the ball kick area 8 lies at a lower level than the collector receiving edge 7 allowing for the ball coming onto the collector 6 from the putting mat 3 to roll due to gravity towards the ball kick area 8.

The putting mat 3 can be any suitable golf playing surface or equivalent, including optionally one whose upper surface closely represents a typical golf green surface and has adequate traction to the floor 15 and is flexible to allow rolling up for storage, such as a rubber mat whose top layer has a short soft pile yarn like Velvet or Chenille. The at least one magnetic member 20 can be any material that is magnetic and has corrosion resistance, such as galvanized steel. The at least one magnetic member 20 can be secured to the putting mat 3 by use of a suitable adhesive or other securement means. The collector 6 can be composed of any material that is generally rigid and has a smooth finish to allow for the ball to roll with little friction like plastic or metal. The kick-back device 9 can be any suitable device having a form of trigger 10 or equivalent that can be triggered (or activated) by a ball entering the ball kick area 8, such that the trigger 10 triggers a plunger 11 or equivalent that pushes the ball with an impulse force in the direction of the golfer. Typically such devices use a solenoid or a spring recoiled by a motor to push the plunger with an impulse force. The trigger 10 can also be a sensor or a simple lever.

There are multiple ways to design the ball roll surface 5, which is the entire upper surface of the collector 6, so that the upper surface of the collector uses gravity to roll the ball towards the ball kick area 8, some of which are described below, and shown in the drawings.

FIG. 6A illustrates the ball roll surface 5 of a first embodiment of the present disclosure, a golf ball return device 1. In the embodiment shown, the ball roll surface 5 has a narrowing downward sloping valley 12 towards the ball kick area 8 on the ball roll surface 5. This can be seen more clearly in FIG. 6B that has multiple equally spaced sectional views of the left arm of the collector 6 in FIG. 6A. As a result, a ball that has rolled onto the collector 6 on either collector arm is likely to roll in a zig-zag path towards the ball kick area 8 as it rolls over each slope of the narrowing downward sloping valley 12 as seen in Path 1 of FIG. 11. An advantage of having a narrowing downward sloping valley 12 on the ball roll surface 5 is that the ball will encounter less rolling resistance even though it has dimples. This also allows for the putting mat thickness p to be insignificant (for example, only a few millimeters, or as low as 6 millimeters) such that it does not require the golfer to have his or her feet on the putting mat 3 when putting, but still allows for the ball to roll towards the ball kick area 8. The collector head 17 that serves as a target has a downward and inward sloping upper face as seen by the shape of the bounce edge 4 and FIG. 6B. While in an ideal scenario the golfer would hit the ball straight such that the ball would go straight to the ball kick area 8 as seen in Path 2 of FIG. 11, the shape of the collector head 17 surface would also serve to direct a ball that has entered from the side to roll towards the other side and then get directed towards the ball kick area 8 as in Path 3 of FIG. 11.

FIG. 7A illustrates the ball roll surface 5 of a second embodiment of the present disclosure. The ball roll surface 5 may be configured to be similar in shape to the inside surface of a cone whose center is in the ball kick area 8 and whose base radius r is slightly greater than the length of the collector arms, and whose height is less than or equal to the putting mat thickness p. As a result, a ball rolling onto the ball roll surface 5 gets directly drawn to the ball kick area 8. This can be seen more clearly in FIG. 7B which shows multiple equally spaced sectional views of the left arm of the collector 6 in FIG. 7A.

Figure 8A:
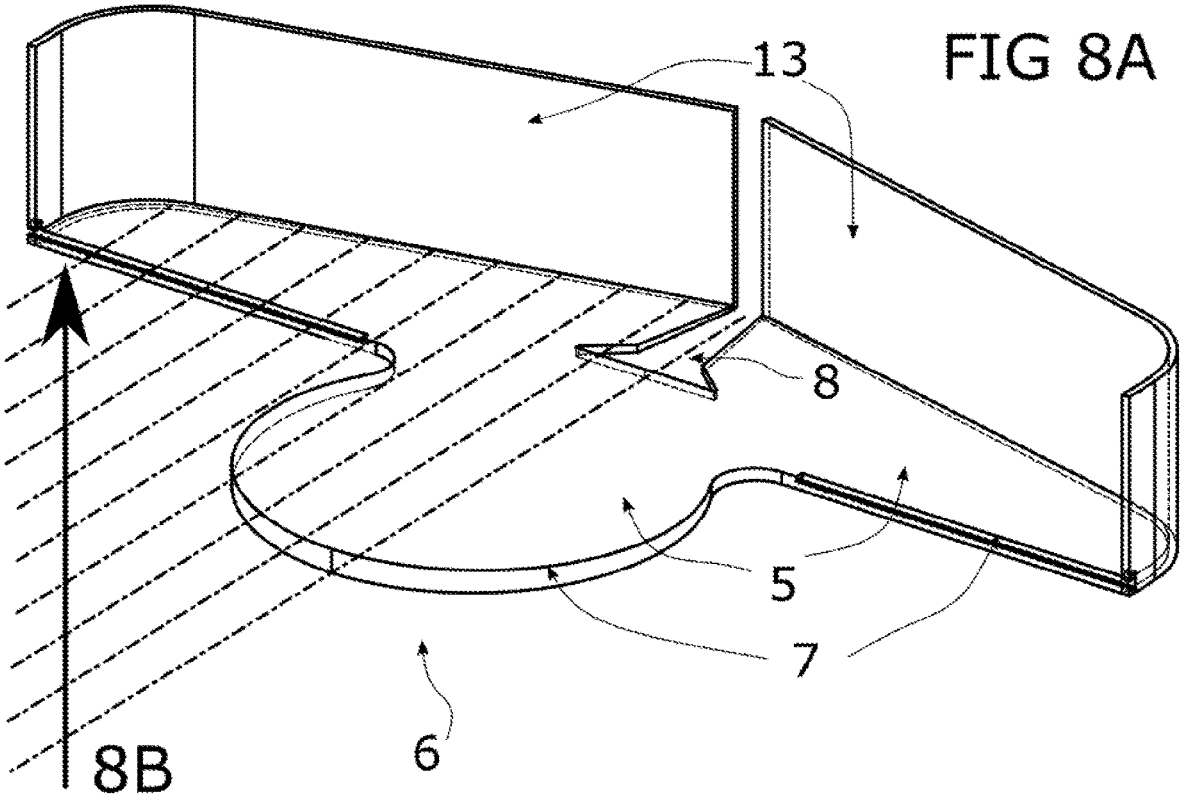
FIG. 8A illustrates a perspective view of the collector according to a third embodiment of the present disclosure.
Figure 8B:
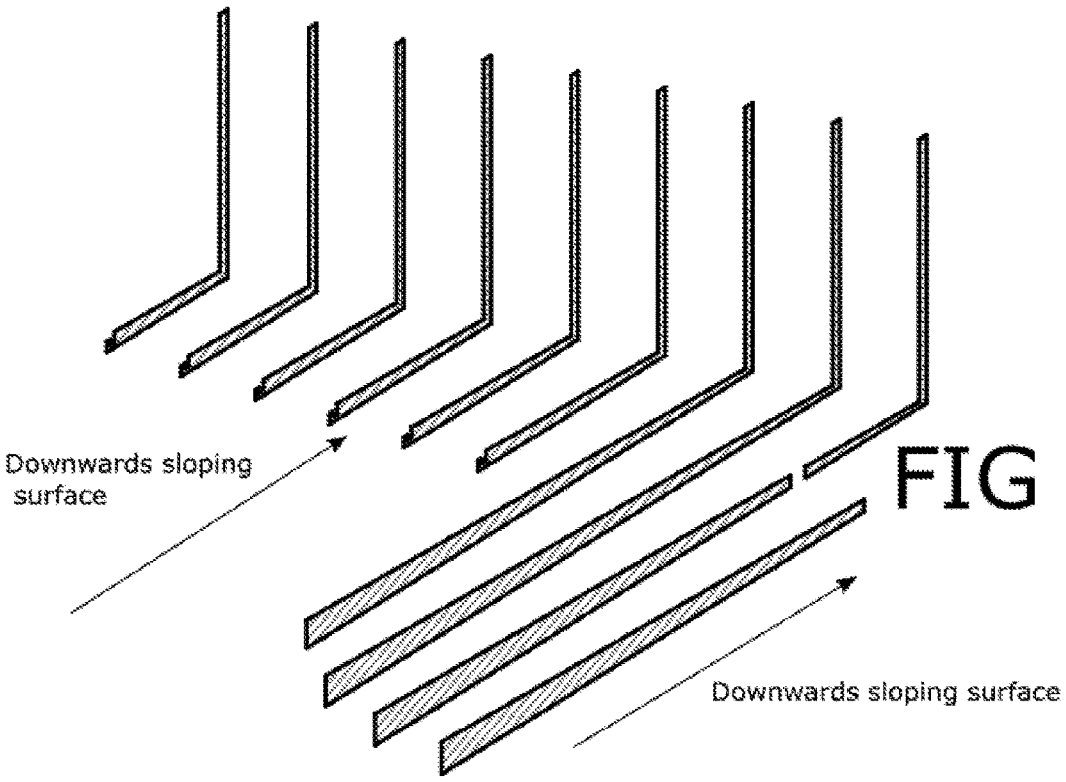
FIG. 8B illustrates perspective section views of multiple sections taken along lines 8B in FIG. 8A

FIG. 8A illustrates the ball roll surface 5 in accordance with an alternate embodiment of the present disclosure. In the embodiment shown, the ball roll surface 5 has a downward sloping surface from the collector receiving edge 7 in the longitudinal forward direction of the putting mat 3. This can be seen more clearly in FIG. 8B that has multiple equally spaced sectional views of the left arm of the collector 6 in FIG. 8A. As a result, a ball that has rolled onto the collector 6 on either collector arm rolls towards the blocking walls 13 and continues to be in contact with them as it rolls towards the ball kick area 8.

Figure 9:
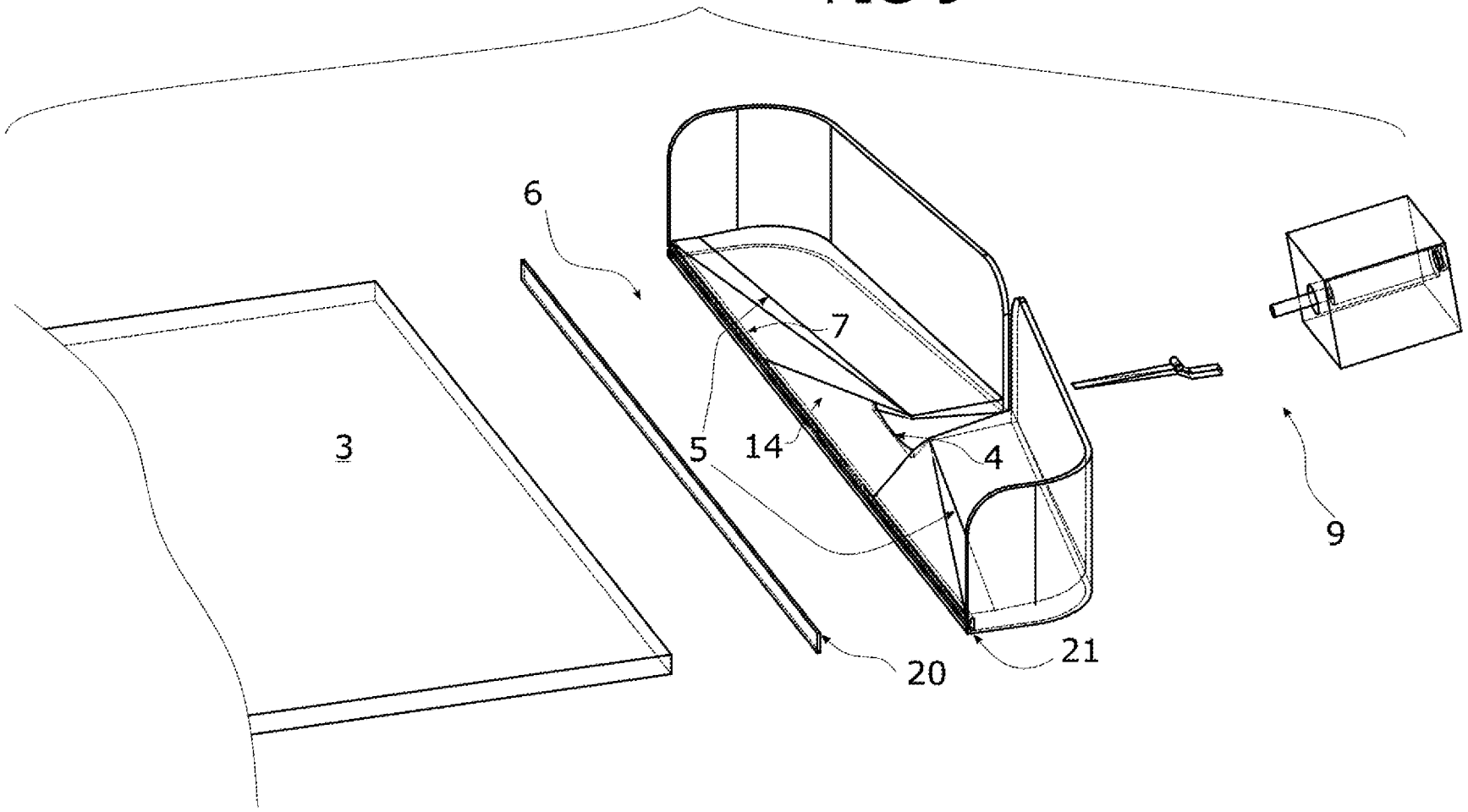
FIG. 9 illustrates an exploded perspective view of a golf ball return device in accordance with one embodiment of the present disclosure.
Figure 10:
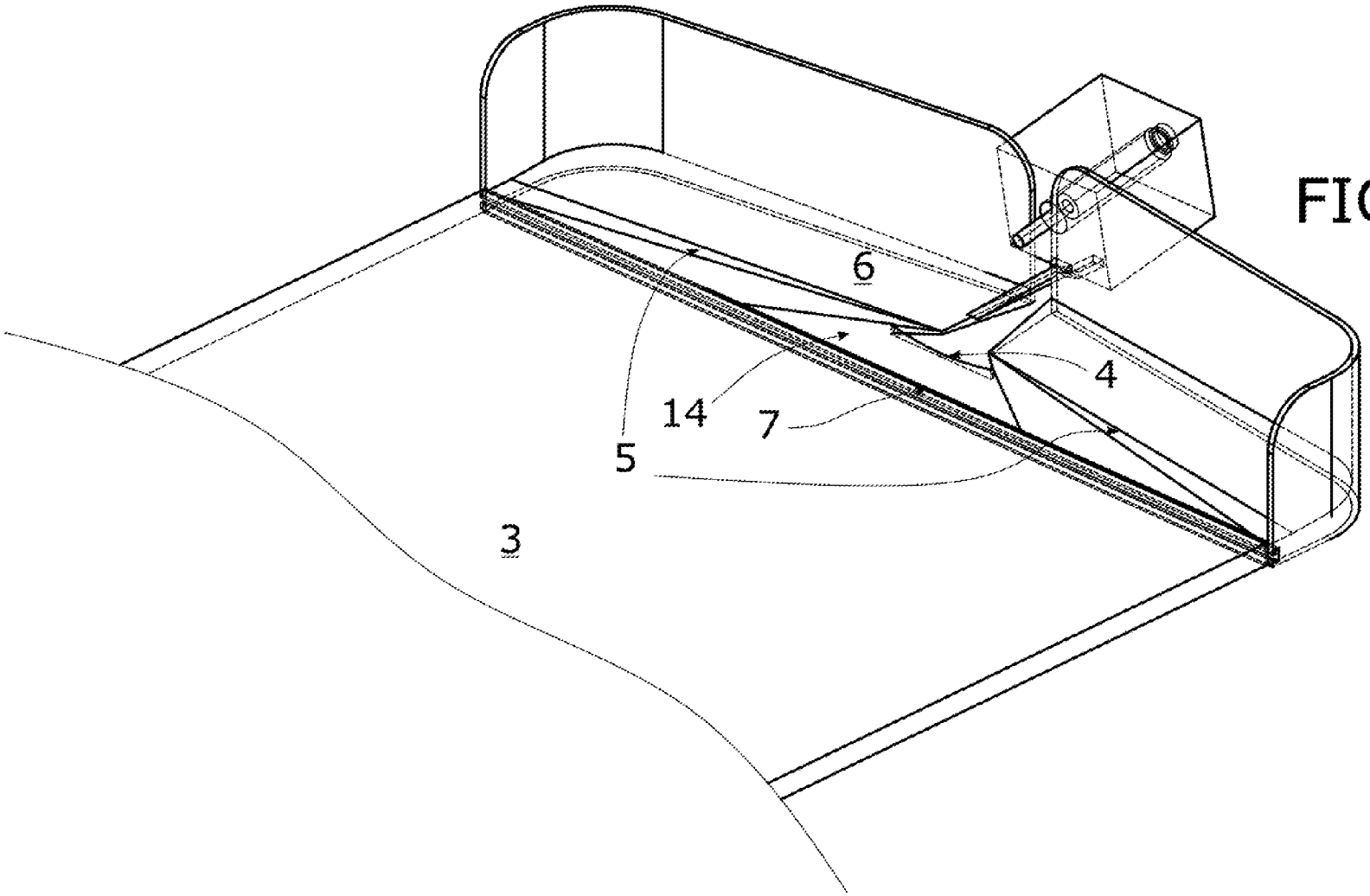
FIG. 10 illustrates an assembled perspective view of a golf ball return device in accordance with one embodiment of the present disclosure.

While the golf ball return device for putting mats 1 may be used with a putting mat 3 that has a cutout 19, a different configuration can also be used with putting mats that may not have a cutout 19. Such putting mats would therefore typically have a straight putting mat distal edge 2. FIG. 9 illustrates a further alternate embodiment of the present disclosure with such a configuration. In the embodiment shown, the device does not have a collector head 17, so its straight collector receiving edge 7 can be abutted against the straight putting mat distal edge 2. In the embodiment shown, the at least one magnetic member 20 extends across (or substantially across) the putting mat distal edge 2 and the corresponding slots for magnets 21 also extends across (or substantially across) the collector receiving edge 7. Again, other suitable securement means may be employed in place of the magnetized components shown and described. In the embodiment shown, the target for the golfer in this embodiment would be the area between the bounce edge 4 and the collector receiving edge 7 with a width equal to, or similar to, the diameter of a typical golf hole, which is 4.25 inches. Optionally, this area could be highlighted on the collector 6 with a different color so the golfer knows where to aim the ball. If the ball roll surface 5 is magnetic, it can allow for a movable flexible target magnetic sheet 14 that can act as a target to be magnetically secured to the ball roll surface 5. The movable flexible target magnetic sheet 14 may be easily moved to move the target elsewhere along the collector receiving edge 7 and maybe very thin so as to not pose any resistance to the rolling ball. It may also be possible to use this embodiment of the present disclosure without a target area or a movable flexible target magnetic sheet 14, if it is being used along with a putting mat 3 that has an actual target golf hole in it. In those cases, it would mostly serve to block and return balls that may have passed the target hole in the putting mat 3.

Figure 11:
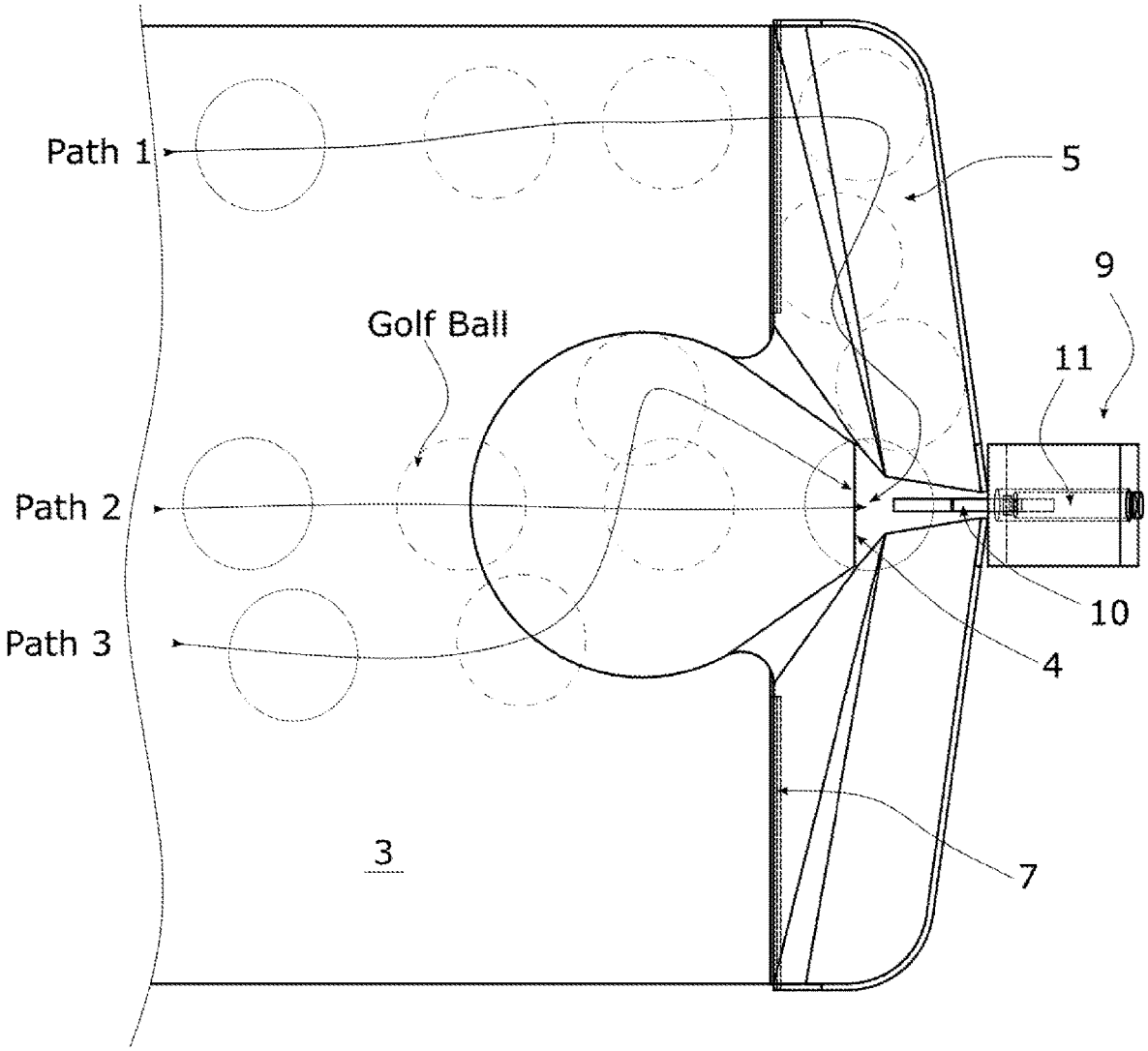
FIG. 11 illustrates a top plan view of a golf ball return device in accordance with one embodiment of the present disclosure showing some of the approach paths taken by a golf ball.

FIG. 11 illustrates a few typical approach paths of a golf ball during operation of the golf ball return device 1 some of which have been referenced while explaining the various embodiments of the present disclosure. These paths by no means represent all possible paths the ball might take while approaching the ball kick area 8. In general, in a typical operation, a golfer would hit the ball in a direction perpendicular to the bounce edge 4 with just about enough force for it to roll over the putting mat distal edge 2. It should be noted that the ball will not encounter any upward slope as it rolls towards the putting mat distal edge 2. On reaching the putting mat distal edge 2 if the ball's center of gravity is over the collector receiving edge 7, it would roll on to the ball roll surface 5 due to the generally downward sloping ball roll surface 5 and get directed by the ball roll surface 5 to the ball kick area 8 to rest before the bounce edge 4. On entering the receiving area 8, the ball would engage the trigger 10 of the kick-back device 9 causing it to move the plunger 11. The force from the plunger causes the ball to bounce against the bounce edge 4 and bounce over the collector receiving edge 7 to travel towards the golfer, typically in a path running through the center of the putting mat 3 also seen in FIG. 12.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, functions, operations, or steps, any of these embodiments may include any modification, combination or permutation of any of the components, elements, functions, operations, or steps described or illustrated anywhere herein that a person having ordinary skill in the art would comprehend. All such modifications, combinations and permutations are believed to be within the sphere and scope of the invention as defined by the claims appended hereto.

I claim:

1. A golf ball return device configured to be disposed on a floor for use with a golf ball by a user, the golf ball return device comprising:

a collector comprising a collector head extending proximal from a ball roll surface that constitutes substantially the entire upper surface of the collector for receiving and directing the golf ball toward a ball kick area;

said ball roll surface having a receiving edge extending on each side of said collector head defining an upper, forwardmost edge of said ball roll surface configured to abut a putting mat; wherein said ball roll surface extends distally from said receiving edge the ball kick area positioned at a lower height from the floor than the height of the receiving edge from the floor;

the ball kick area operatively connected to a ball kick-back device;

the ball kick-back device for hitting the golf ball toward the user;

wherein the ball roll surface is not on a horizontal plane such that the golf ball is directed by gravity and the ball roll surface from the at least one receiving edge to the ball kick area.

2. The device of claim 1, further comprising an at least one blocking wall disposed at a distal end of the device, the at least one blocking wall for preventing the golf ball from exiting the device at its distal end.

3. The device of claim 1, further comprising two blocking walls, wherein the ball kick-back device extends through a slot between the two blocking walls.

4. The device of claim 1, wherein the ball kick-back device comprises a trigger operatively connected to a plunger, wherein the trigger is activated by the golf ball entering the ball kick area, such that the trigger engages the plunger to drive the golf ball out of the ball kick area.

5. The device of claim 1, wherein the ball roll surface is indented.

6. The device of claim 1, further comprising at least one magnet disposed adjacent to the at least one receiving edge.

7. The device of claim 1, further comprising a putting mat having an upper surface, first and second ends, a substantially vertical planar surface at a second end thereof, said at least one receiving edge abutting the substantially vertical planar surface of said putting mat.

8. The device of claim 7, wherein the at least one receiving edge is disposed at a height from the floor less than or equal to the height of the upper surface of the putting mat from the floor.

9. The device of claim 8, further comprising at least one magnet disposed adjacent to the at least one receiving edge;

a least one magnetic member disposed adjacent to the substantially vertical planar surface of the putting mat.

10. The device of claim 9, wherein said collector head partially circular in shape with a radius equivalent to the radius of a standard golf hole, and wherein the putting mat has a cutout towards its second end to snugly fit said collector head.

11. The device of claim 10, wherein the collector head has a downward inward sloping surface towards the ball kick area, and the ball roll surface has a narrowing downward valley for directing the golf ball toward the ball kick area by gravity.

12. The device of claim 10, wherein the ball roll surface comprises an inward sloping surface for directing the golf ball toward the ball kick area by gravity.

13. The device of claim 10, wherein the ball roll surface comprises a downward sloping surface longitudinally towards the distal end of the collector for directing a golf ball toward the ball kick area by gravity.

14. A golf ball return device configured to be disposed on a floor for use with a golf ball by a user, the golf ball return device comprising:

a collector comprising a collector head extending proximal from a ball roll surface for receiving and directing the golf ball toward a ball kick area;

said collector having a receiving edge extending from a first end of the device to a second end of the device defining an upper, forwardmost edge of a substantially vertical perimeter wall of the collector;

wherein said ball roll surface extends distally from said receiving edge;

the ball kick area positioned at a lower height from the floor than the height of the receiving edge from the floor;

the ball kick area operatively connected to a ball kick-back device; the ball kick-back device for hitting the golf ball toward the user;

wherein the ball roll surface is not on a horizontal plane such that the golf ball is directed by gravity and the ball roll surface from the at least one receiving edge to the ball kick area.

15. The device of claim 14, further comprising an at least one blocking wall disposed at a distal end of the device, the at least one blocking wall for preventing the golf ball from exiting the device at its distal end.

16. The device of claim 14, further comprising two blocking walls, wherein the ball kick-back device extends through a slot between the two blocking walls.

17. The device of claim 14, wherein the ball kick-back device comprises a trigger operatively connected to a plunger, wherein the trigger is activated by the golf ball entering the ball kick area, such that the trigger engages the plunger to drive the golf ball out of the ball kick area.

18. The device of claim 14, wherein the ball roll surface of the collector is indented.

19. The device of claim 14, further comprising at least one magnet disposed adjacent to the at least one receiving edge.

* * * * *